US006334413B1

(12) United States Patent
Hattori et al.

(10) Patent No.: US 6,334,413 B1
(45) Date of Patent: Jan. 1, 2002

(54) ELECTROMAGNETIC ACTUATING SYSTEM

(75) Inventors: Hiroyuki Hattori; Takashi Izuo; Masahiko Asano; Tatsuo Iida, all of Toyota; Shoichiro Nitta, Nishikamo-gun, all of (JP)

(73) Assignee: Toyota Jidosha Kabushiki Kaisha, Toyota (JP)

( * ) Notice: Subject to any disclaimer, the term of this patent is extended or adjusted under 35 U.S.C. 154(b) by 0 days.

(21) Appl. No.: 09/452,798

(22) Filed: Dec. 2, 1999

(30) Foreign Application Priority Data

Dec. 7, 1998 (JP) ..... 10-347405

(51) Int. Cl.[7] ..... F01L 9/04; F02D 13/02
(52) U.S. Cl. ..... 123/90.11
(58) Field of Search ..... 123/90.11

(56) References Cited

U.S. PATENT DOCUMENTS

| | | | | |
|---|---|---|---|---|
| 4,533,890 A | | 8/1985 | Patel | 335/234 |
| 4,749,167 A | | 6/1988 | Gottschall | 251/65 |
| 4,779,582 A | | 10/1988 | Lequesne | 123/90.11 |
| 4,829,947 A | | 5/1989 | Lequesne | 123/90.11 |
| 5,868,108 A | * | 2/1999 | Schmitz et al. | 123/90.11 |
| 6,039,014 A | * | 3/2000 | Hoppie | 123/90.11 |

FOREIGN PATENT DOCUMENTS

| | | | |
|---|---|---|---|
| DE | 3500530 A1 | 7/1986 | F01L/9/04 |
| EP | 0 328 194 A | 8/1989 | F01L/9/04 |
| JP | 02286813 | 11/1990 | F01L/9/04 |
| JP | 3-44010 | 2/1991 | |
| JP | 7-335437 | 12/1995 | |
| JP | 10047028 | 2/1998 | F01L/9/04 |

* cited by examiner

*Primary Examiner*—Weilun Lo
(74) *Attorney, Agent, or Firm*—Kenyon & Kenyon

(57) ABSTRACT

An electromagnetic actuating system having a valve member is provided. This system can improve a response of movement of the valve member while reducing power consumption of the system. The electromagnetic actuating system includes an armature which moves with the valve member, an electromagnet which attracts the armature in a direction of movement of the valve member by being supplied with a current, and a spring which presses the armature away from the electromagnet. A permanent magnet which can exert a magnetic attracting force between the armature and the electromagnet is provided. A current controller supplies a release current to the electromagnet so that magnetic flux is generated in a direction opposite to a direction of magnetic flux generated by the permanent magnet when the armature is released from the electromagnet. The valve member functions as an intake valve or an exhaust valve of an internal combustion engine, and the current controller controls an amount of the release current in accordance with an operating state of the internal combustion engine.

12 Claims, 5 Drawing Sheets

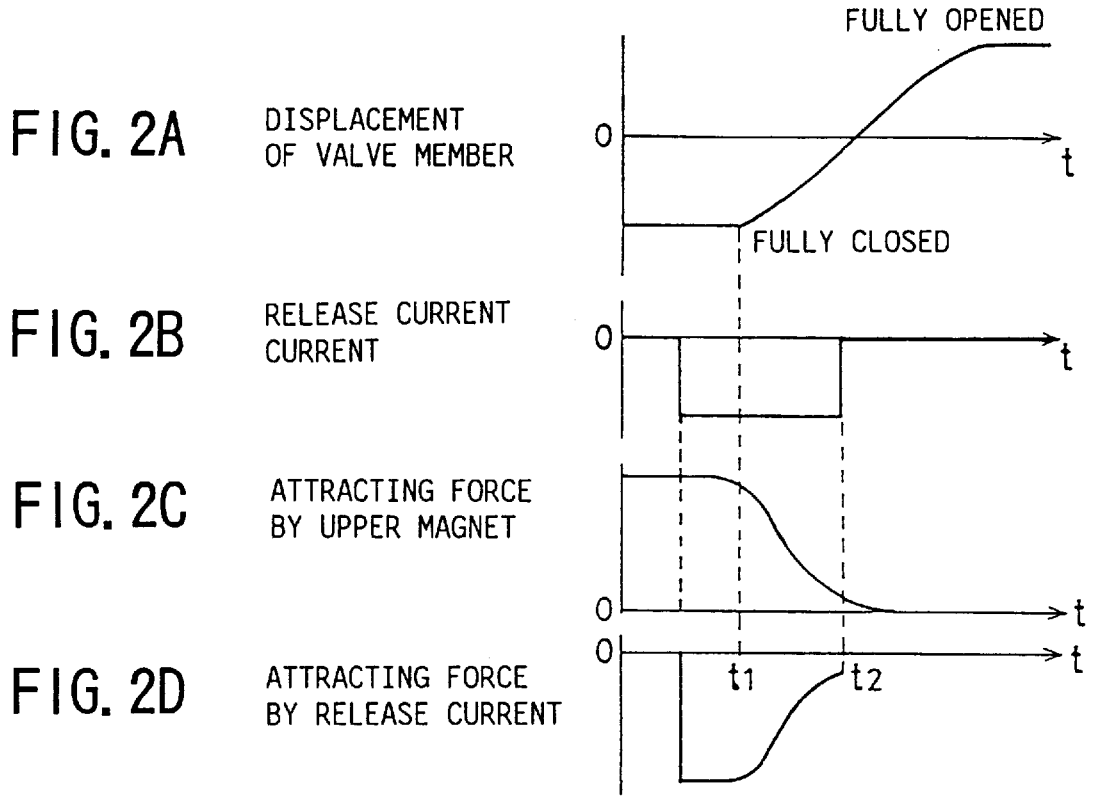
FIG. 3
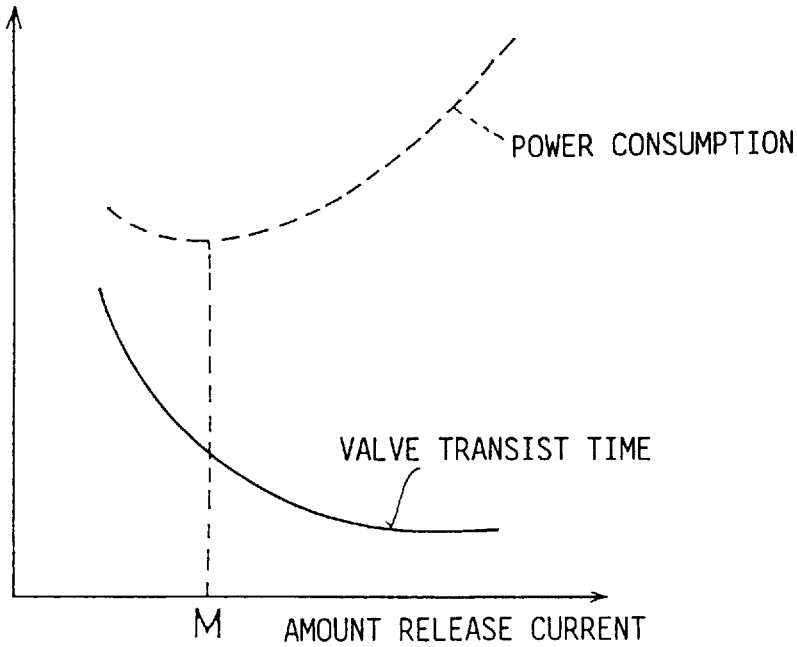

FIG. 5A
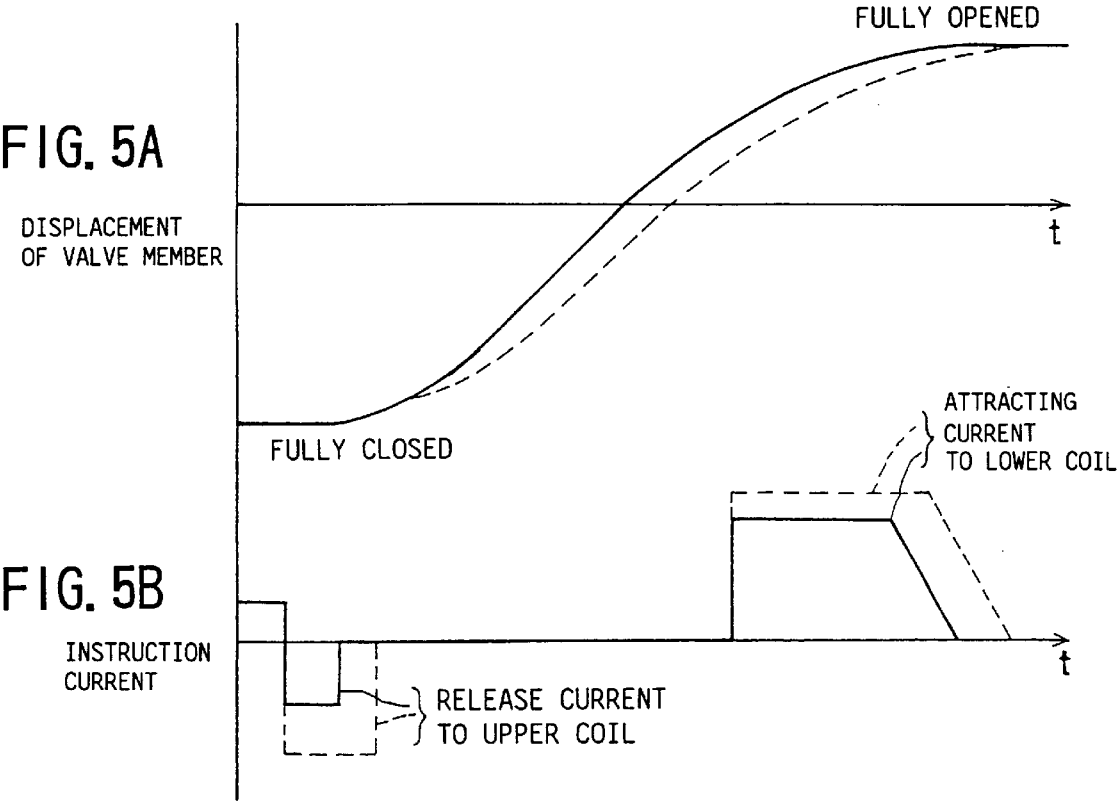
FIG. 5B
FIG. 6
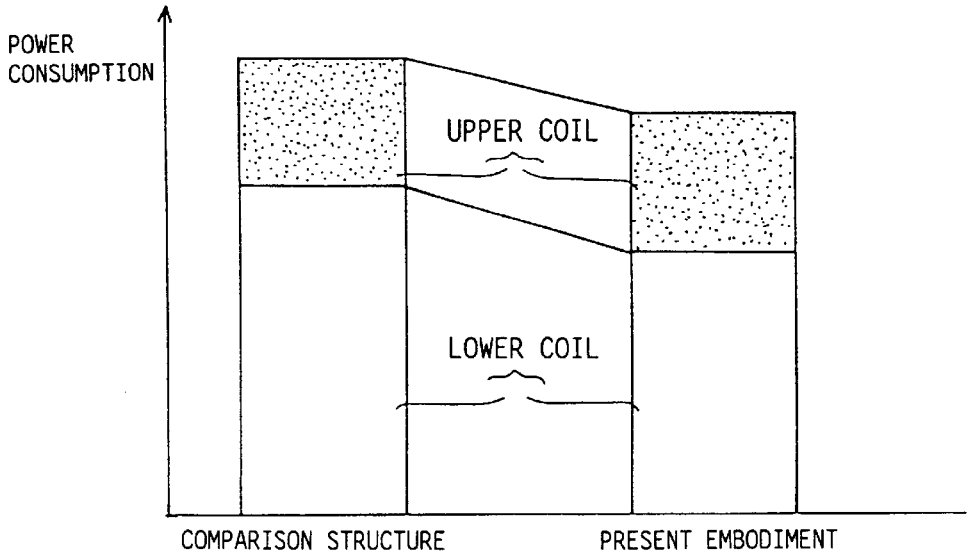

ELECTROMAGNETIC ACTUATING SYSTEM

BACKGROUND OF THE INVENTION

1. Field of the Invention

The present invention relates to an electromagnetic actuating system, and particularly to an electromagnetic actuating system which actuates a valve member by cooperation of an electromagnetic force generated by an electromagnet and a resilient force generated by a spring.

2. Description of the Related Art

Conventionally, a solenoid valve is known as disclosed in Japanese Laid-Open Patent Application No. 7-335437. The solenoid valve has a valve member which is movably guided in an axial direction. An armature is connected to the valve member, and a pair of electromagnets are provided on respective sides of the armature. The armature is pressed toward a neutral position between the electromagnets by a pair of springs. When an exciting current is supplied to one of the electromagnets, an electromagnetic force is exerted on the armature in a direction toward that electromagnet. Thus, according to the above-mentioned solenoid valve, it is possible to actuate the valve member to be closed and opened by alternately supplying exciting currents to the electromagnets. In such a solenoid valve, it is desired to actuate the valve member with a high response while reducing power consumption of the solenoid valve.

SUMMARY OF THE INVENTION

It is an object of the present invention to provide an electromagnetic actuating system which can actuate a valve member with a high response while reducing power consumption of the system.

The above-mentioned object of the present invention can be achieved by an electromagnetic actuating system, comprising: a valve member; an armature which moves with the valve member; an electromagnet which attracts the armature in a direction of movement of the valve member by being supplied with a current; a spring which presses the armature away from the electromagnet; a permanent magnet which can exert a magnetic attracting force between the armature and the electromagnet; and a current controller which supplies a release current to the electromagnet so that magnetic flux is generated in a direction opposite to a direction of magnetic flux generated by the permanent magnet when the armature is released from the electromagnet. When the valve member functions as an intake valve or an exhaust valve of an internal combustion engine, the current controller may control an amount of the release current in accordance with an operating state of the internal combustion engine.

In the invention, the permanent magnet can exert a magnetic attracting force between the armature and the electromagnet. Thus, a current which is required to be supplied to the electromagnet to attract the armature can be reduced. On the other hand, the magnetic attracting force generated by the permanent magnet acts on the armature against movement thereof when the armature is released from the electromagnet. The current controller supplies the release current to the electromagnet so that magnetic flux is generated in a direction opposite to a direction of magnetic flux generated by the permanent magnet when the armature is released from the electromagnet. Thus, the magnetic attracting force against the movement of the armature can be reduced. Consequently, it is possible to improve a response of movement of the valve member. That is, it is possible to shorten a time which is required for the valve member to move from one of a fully closed position and a fully opened position to the other (hereinafter referred to as a valve transition time).

In the invention, the valve transition time becomes smaller for a larger amount of the release current since the magnetic attracting force generated by the permanent magnet is reduced to a greater extent. On the other hand, as the amount of the release current becomes larger, the power consumption becomes greater. Thus, the amount of the release current which achieves an optimum valve transition time is not identical to the amount of the release current which minimizes the power consumption of the system. In the invention, the current controller controls the amount of the release current in accordance with the operating state of the internal combustion engine. Thus, according to the invention, it is possible to achieve a valve transition time which is required in accordance with the operating state of the internal combustion engine while reducing the power consumption of the electromagnetic actuating system. When the valve member functions as the exhaust valve of the internal combustion engine, the electromagnet may attract the armature in a valve opening direction.

In this invention, the exhaust valve is opened in a situation where a relatively high combustion pressure remains in a combustion chamber of the internal combustion engine. Thus, a large electromagnetic force must be exerted on the armature in a valve opening direction so as to actuate the exhaust valve against the high pressure in the combustion chamber. According to the invention, since the permanent magnet can exert a magnetic attracting force between the armature and the electromagnet which attracts the armature in the valve opening direction, it is possible to reduce power consumption of the system when the valve member is actuated to be opened.

When the valve member functions as the intake valve of the internal combustion engine, the electromagnet may attract the armature in a valve closing direction. In this invention, a time for which the intake valve is held in a fully closed position is relatively long. Thus, electric power required to hold the intake valve in the fully closed position occupies a relatively large part of the total power consumption of the electromagnetic actuating system. According to the invention, since the permanent magnet can exert a magnetic attracting force between the armature and the electromagnet which attracts the armature in the valve closing direction, it is possible to reduce power consumption of the system when the valve member is held in the fully closed position.

Other objects and further features of the present invention will be apparent from the following detailed description when read in conjunction with the accompanying drawings.

BRIEF DESCRIPTION OF THE DRAWINGS

FIG. 2A is a time chart showing a displacement of a valve member when the valve member moves from a fully closed position to a fully opened position;

FIG. 2B is a time chart showing a release current supplied to an upper coil;

FIG. 2C is a time chart showing a magnetic force exerted by an upper magnet on an armature;

FIG. 2D is a time chart showing an electromagnetic force exerted on the armature by the release current supplied to the upper coil;

FIG. 3 is a diagram showing a valve transition time and power consumption of the system against an amount of the release current;

FIG. 5A is a time chart showing a displacement of the valve member when the valve member moves from the fully closed position to the fully opened position;

FIG. 5B is a time chart showing the release current and an attracting current supplied to the upper coil and a lower coil, respectively;

FIG. 6 is a diagram showing power consumption of the electromagnetic actuating system of the present embodiment and a comparison structure with a distribution to the upper coil and the lower coil.

DESCRIPTION OF THE PREFERRED EMBODIMENTS

Figure 1:
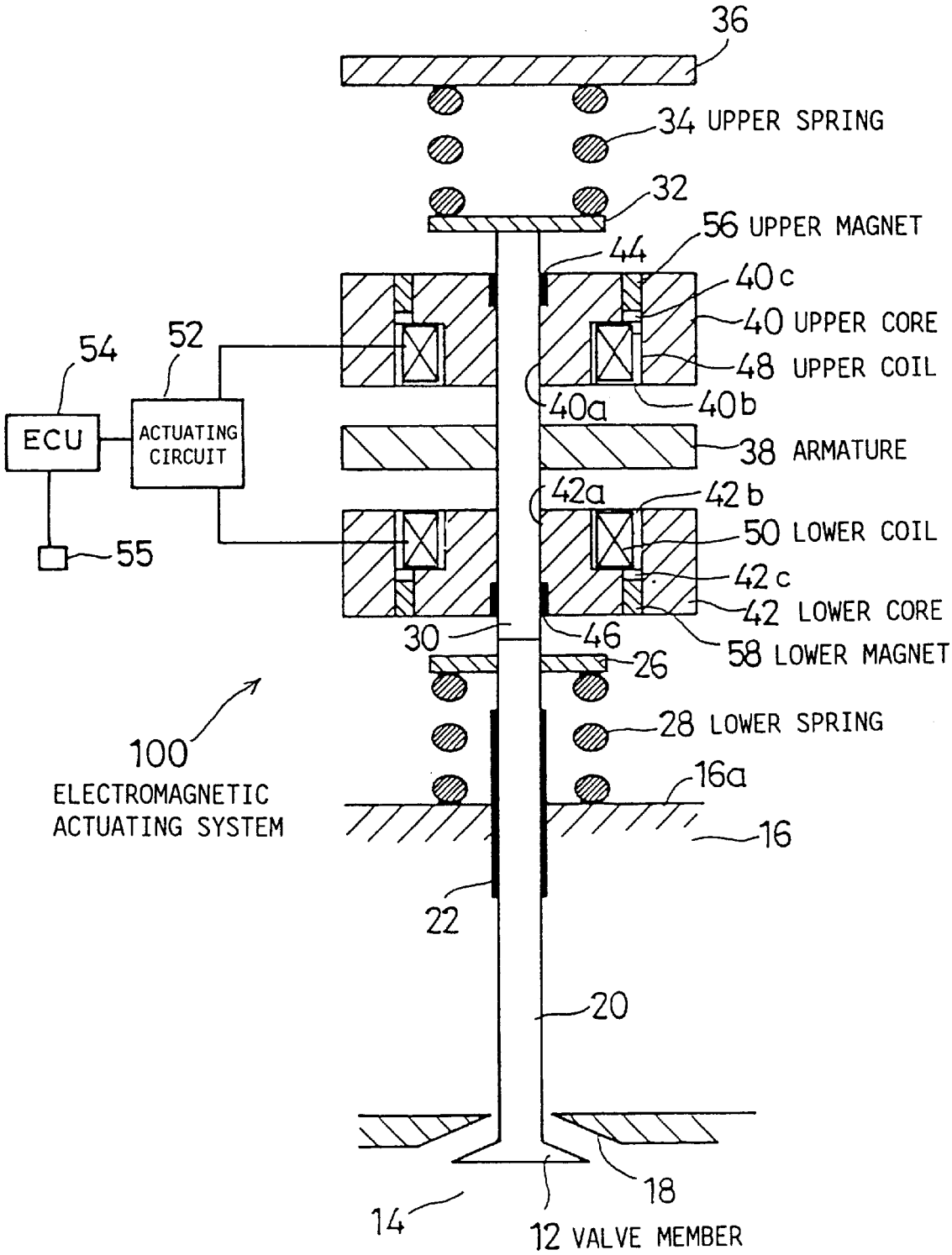
FIG. 1 is a diagram showing an electromagnetic actuating system of a first embodiment of the present invention.

FIG. 1 is a diagram showing an electromagnetic actuating system 100 according to a first embodiment of the present invention. As shown in FIG. 1, the electromagnetic actuating system 100 has a valve member 12. In the present embodiment, the valve member 12 functions as an intake valve or an exhaust valve of an internal combustion engine (hereinafter simply referred to as an engine). The valve member 12 is disposed in a cylinder head 16 so that the valve member 12 is exposed in a combustion chamber 14 of the engine. The cylinder head 16 is provided with a valve seat 18 which is associated with the valve member 12.

The valve member 12 has a valve shaft 20 which extends upwardly in FIG. 1. The valve shaft 20 is guided by a valve guide 22 so that the valve shaft 20 can move in an axial direction. The valve guide 22 is supported in the cylinder head 16. A lower retainer 26 is fixed to an upper end part of the valve shaft 20. A lower spring 28 is disposed between the lower retainer 26 and a spring supporting surface 16*a* formed in the cylinder head 16. The lower spring 28 generates a resilient force which presses the valve member 12 via the lower retainer 26 in an upward direction, that is, in a valve closing direction.

An armature shaft 30 is disposed coaxially with the valve shaft 20. The armature shaft 30 is made of a non-magnetic material. A lower end face of the armature shaft 30 is in contact with an upper end face of the valve shaft 20. An upper retainer 32 is fixed to an upper end part of the armature shaft 30. A lower end of an upper spring 34 abuts on a top surface of the upper retainer 32. An upper end of the upper spring 34 abuts on an upper cap 36 which is fixed to the cylinder head 16. The upper spring 34 pushes the armature shaft 30 via the upper retainer 32 in a downward direction. Thus, the upper spring 34 pushes the valve member 12 in a downward direction, that is, in a valve opening direction.

An armature 38 is fixed to an outer circumferential surface of the armature shaft 30 at a substantially center position in an axial direction thereof. The armature 38 is an annular member which is made of a soft magnetic material.

An upper core 40 is disposed above the armature 38, and a lower core 42 is disposed below the armature 38. Each of the upper core 40 and the lower core 42 is a substantially cylindrical member made of a magnetic material. The upper core 40 and the lower core 42 are provided with through holes 40*a* and 42*a*, respectively, which go though the center parts thereof. An upper bush 44 is disposed in an upper end part of the through hole 40*a*, and a lower bush 46 is disposed in a lower end part of the through hole 42*a*. The armature shaft 30 extends through the through holes 40*a*, 42*a*, and is guided by the upper bush 44 and the lower bush 46 so that the armature shaft 30 can move in the axial direction.

Annular recesses 40*b* and 42*b* are formed on faces of the upper core 40 and the lower core 42, respectively, facing the armature 38. An upper coil 48 and a lower coil 50 are contained in the annular recesses 40*b* and 42*b*, respectively.

The upper coil 48 and the lower coil 50 are electrically connected to an actuating circuit 52. The actuating circuit 52 supplies predetermined instruction currents to the upper coil 48 and the lower coil 50 in accordance with a control signal supplied from an electronic control unit (hereinafter referred to as an ECU) 54.

A revolution sensor 55 is connected to the ECU 54. The revolution sensor 55 outputs a signal to the ECU 54 in accordance with a revolution speed of the engine (hereinafter referred to as an engine speed NE). The ECU 54 detects the engine speed NE based on the output signal of the revolution sensor 55.

The upper core 40 is provided with an annular slit 40*c* which extends from an upper face of the upper core 40 to an upper face of the annular recess 40*b*. Similarly, the lower core 42 is provided with an annular slit 42*c* which extends from a lower face of the lower core 42 to a bottom face of the annular recess 42*b*. An upper magnet 56 and a lower magnet 58 are supported in the annular slits 40*c* and 42*c*, respectively. Each of the upper magnet 56 and the lower magnet 58 is a permanent magnet having an annular shape. The upper magnet 56 and the lower magnet 58 are radially magnetized so that, for the upper magnet 56, an inner side is an S pole and an outer side is an N pole, and, for the lower magnet 58, an inner side is an N pole and an outer side is an S pole, for example. According to such directions of magnetization, magnetic flux generated by the upper magnet 56 and magnetic flux generated by the lower magnet 58 go through the armature 38 in opposite directions to each other so that concentration of the flux is relaxed in the armature 38. Thus, a loss of electric power due to eddy currents can be reduced.

Next, a description will be given of an operation of the electromagnetic actuating system 100.

When the armature 38 is in contact with the upper core 40, the magnetic flux generated by the upper magnet 56 goes through the upper core 40 and the armature 38. In such a situation, a magnetic attracting force is exerted between the armature 38 and the upper core 40. The upper magnet 56 is so constructed that the above-mentioned magnetic attracting force is strong enough to maintain the armature 38 in contact with the upper core 40 against a resilient force of the upper spring 34. Thus, a state in which the armature 38 is in contact with the upper core 40 can be maintained without energizing the upper coil 48. In this state, the valve member 12 is seated on the valve seat 18. Hereinafter, a position of the armature 38 or the valve member 12 in a state where the armature 38 is in contact with the upper core 40 is referred to as a fully closed position of the armature 38 or the valve member 12.

When the upper coil 48 is supplied with an instruction current which generates magnetic flux in a direction opposite to a direction of the magnetic flux generated by the upper magnet 56 in a state where the armature 38 is held in the fully closed position, the magnetic attracting force exerted between the armature 38 and the upper core 40 becomes smaller than the resilient force of the upper spring 34. Thus, the armature 38 starts moving in a downward direction in FIG. 1 by being pressed by the upper spring 34.

When the armature 38 has reached a predetermined position, the lower coil 50 is supplied with an instruction current which generates magnetic flux in the same direction as magnetic flux generated by the lower magnet 58. In this case, an attracting force which attracts the armature 38 toward the lower core 42, that is, an attracting force which actuates the valve member 12 in a downward direction in FIG. 1, is generated.

When this attracting force is exerted on the armature 38, the armature 38 downwardly moves with the valve member 12 against a resilient force of the lower spring 28. In this case, since the magnet flux generated by the lower coil 50 and the magnet flux generated by the lower magnet 58 have the same direction as mentioned above, the attracting force which attracts the armature 38 toward the lower core 42 is increased by an extent corresponding to a magnitude of the magnetic flux generated by the lower magnet 58 when the armature 38 comes close to the lower core 42. The valve member 12 continues to move until the armature 38 comes into contact with the lower core 42. Hereinafter, a position of the armature 38 or the valve member 12 in a state where the armature 38 is in contact with the lower core 42 is referred to as a fully opened position of the armature 38 or the valve member 12.

When the armature 38 has reached the fully opened position, the lower coil 50 is de-energized. In this case, the attracting force generated by the lower coil 50 vanishes and only the magnetic attracting force generated by the lower magnet 58 is exerted between the armature 38 and the lower core 42. The lower magnet 58 is so constructed that this magnetic attracting force is strong enough to maintain the armature 38 in contact with the lower core 42 against the resilient force of the lower spring 28. Thus, the valve member 12 and the armature 38 are maintained in the fully opened position after the lower coil 50 has been de-energized.

When the lower coil 50 is supplied with an instruction current which generates magnetic flux in a direction opposite to a direction of the magnetic flux generated by the lower magnet 56 in a state where the armature 38 is held in the fully opened position, the attracting force exerted between the armature 38 and the lower core 42 becomes smaller than the resilient force of the lower spring 28. Thus, the armature 38 starts moving in an upward direction in FIG. 1 by being pressed by the lower spring 28.

When the armature 38 has reached a predetermined position, the upper coil 48 is supplied with an instruction current which generates magnetic flux in the same direction as the magnetic flux generated by the upper magnet 56. In this case, an attracting force which attracts the armature 38 toward the upper core 40, that is, an attracting force which actuates the valve member 12 in an upward direction in FIG. 1, is generated.

When the above attracting force is exerted on the armature 38, the armature 38 upwardly moves with the valve member 12 against the resilient force of the upper spring 34. In this case, since the magnet flux generated by the upper coil 48 and the magnet flux generated by the upper magnet 56 have the same direction as mentioned above, the attracting force which attracts the armature 38 toward the upper core 40 is increased by an extent corresponding to a magnitude of the magnetic flux generated by the upper magnet 56 when the armature 38 comes close to the upper core 40. The valve member 12 continues to move until the armature 38 comes into contact with the upper core 40, that is, until the valve member 12 and the armature 38 reach the fully closed position. The valve member 12 and the armature 38 can be maintained in the fully closed position after the upper coil 48 is de-energized, as mentioned above.

Hereinafter, the instruction current which is supplied to the upper coil 48 or the lower coil 50 for releasing the armature 38 from the fully closed position or the fully opened position (that is, the instruction current which generates the magnetic flux in a direction which is opposite to the direction of the magnetic flux generated by the upper magnet 56 or the lower magnet 58) is referred to as a release current. Additionally, the current which is supplied to the upper coil 48 or the lower coil 50 for attracting the armature 38 toward the fully closed position or the fully opened position (that is, the instruction current which generates the magnetic flux in the same direction as the magnetic flux generated by the upper magnet 56 or the lower magnet 58) is referred to as an attracting current.

As described above, according to the electromagnetic actuating system 100, it is possible to actuate the valve member 12 between the fully closed position and the fully opened position by supplying the attracting current and the release current to the upper coil 48 and the lower coil 50 at proper timings.

It should be noted that the electromagnetic actuating system 100 is constructed so that a tappet clearance is formed between the armature shaft 30 and the valve shaft 20 in a state where the valve member 12 and the armature 38 are held in the fully closed position, that is, in a state where the valve member 12 is seated on the valve seat 18 and the armature 38 is in contact with the upper core 40. According to this structure, the tappet clearance can absorb a change in a relative position of the valve shaft 20 and the armature shaft 30 due to a difference in a thermal expansion between the cylinder head 16 and the valve shaft 20 or wear of the valve seat 18 and the valve member 12.

As mentioned above, the armature 38 can be maintained in the fully closed position or the fully opened position by the magnetic attracting force generated by the upper magnet 56 or the lower magnet 58 without a necessity of energizing the upper coil 48 or lower coil 50 in the present embodiment. Additionally, since the magnetic attracting force generated by the upper magnet 56 or the lower magnet 58 is exerted on the armature 38 when the armature 38 is actuated toward the fully closed position or the fully opened position, it is possible to reduce the attracting currents required to be supplied to the upper coil 48 and the lower coil 50. Thus, according to the present embodiment, it is possible to effectively reduce power consumption of the electromagnetic actuating system 100.

However, when the valve member 12 starts moving from the fully closed position or the fully opened position, the magnetic attracting force generated by the upper magnet 56 or the lower magnet 58 acts against movement of the armature 38. Thus, if the upper magnet 56 and the lower magnet 58 are simply provided, a time which is required for the valve member 12 to move between the fully closed position and the fully opened position (hereinafter referred to as a valve transit time) could be increased, resulting in a low response of the movement of the valve member.

In the present embodiment, the attracting forces generated by the upper magnet 56 and the lower magnet 58 can be quickly cancelled by supplying the release currents to the upper coil 48 and the lower coil 50, respectively, when the valve member 12 starts moving from the fully closed position and the fully opened position, respectively, as mentioned above. Thus, according to the present embodiment, it is possible to prevent an attracting force from being exerted on the armature 38 against the movement thereof so that the valve member 12 can start moving from the fully closed position and the fully opened position with a high response.

FIGS. 2A to 2D are time charts showing a displacement of the valve member 12, a release current supplied to the upper coil 48, a magnetic attracting force exerted on the armature 38 by the upper magnet 56, and an electromagnetic force exerted on the armature 38 by the upper coil 48 being supplied with the release current, respectively, when the valve member 12 moves from the fully closed position to the fully opened position.

As shown in FIG. 2A, the valve member 12 starts moving at a time t1, and, as shown in FIG. 2C, the magnetic attracting force generated by the upper magnet 56 continues to be exerted between the armature 38 and the upper core 40 after the armature 38 has been released from the upper core 40. In the preset embodiment, the release current continues to be supplied to the upper core 48 until a time t2 at which the valve member 12 is spaced away from the upper core 40 such that the magnetic attracting force exerted by the upper magnet 56 between the armature 38 and the upper core 40 becomes sufficiently small. Thus, as can be seen from FIGS. 2C and 2D, the magnetic attracting force generated by the upper magnet 56 is substantially cancelled by the electromagnetic force generated by the upper coil 48. As a result, the valve member 12 can move from the fully closed position toward the fully opened position with a high response. Similarly, the valve member 12 can move from the fully opened position toward the fully closed position with a high response by the release current being supplied to the lower coil 50 after the armature 38 is released from the lower core 42.

As mentioned above, the attracting force can be prevented from being exerted on the armature 38 against the movement thereof when the armature 38 starts moving from the fully closed position or the fully opened position. Thus, according to the present embodiment, it is possible to actuate the valve member 12 with a high response, that is, to shorten the valve transit time. Additionally, since kinetic energy of the armature 38 can be prevented from being lost by the magnetic attracting force generated by the upper magnet 56 or the lower magnet 58, it is unnecessary to increase the attracting current supplied to the opposite lower coil 50 or the upper coil 48 to compensate for the energy loss of the armature 38. Thus, power consumption of the electromagnetic actuating system 100 can be reduced.

When an amount of the release current changes, the valve transit time of the valve member 12 and power consumption of the electromagnetic actuating system 100 also change. FIG. 3 is a diagram showing the valve transit time of the valve member 12 and the power consumption of the electromagnetic actuating system 100 against a change in the amount of the release current by a solid line and a dotted line, respectively. It should be noted that the amount of the release current is a value obtained by integrating the release current. Thus, when at least one of a time during which the release current is supplied and a magnitude of the release current is changed, the amount of the release current is changed.

As the amount of the release current becomes larger, the magnetic attracting current exerted on the armature 38 by the upper magnet 56 or the lower magnet 58 is cancelled to a larger extent. Thus, as shown in FIG. 3, the valve transit time decreases as the amount of the release current increases.

Additionally, when the amount of the release current to the upper coil 48 increases, power consumption of the system corresponding to the release current to the upper coil 48 increases. In this case, since the magnetic attracting force exerted by the upper magnet 56 on the armature 38 is cancelled to a larger extent as mentioned above, the attracting current to be supplied to the lower coil 50 decreases. Thus, power consumption of the system corresponding to the attracting current to the lower coil 50 decreases. Similarly, when the amount of the release current to the lower coil 50 increases, power consumption of the system corresponding to the release current to the lower coil 50 increases and power consumption of the system corresponding to the attracting current to the upper coil 48 decreases. In this way, the power consumption corresponding to the release current and the power consumption corresponding to the attracting current change in opposite directions when the amount of the release current changes. Thus, the total power consumption of the electromagnetic actuating system 100 exhibits a minimum value when the amount of the release current is equal to a certain value M as indicated by the dotted line in FIG. 3.

As mentioned above, the valve transit time of the valve member 12 and the power consumption of the electromagnetic actuating system 100 change in accordance with a change in the amount of the release current. Thus, when the engine is operating with a high revolution speed exceeding a predetermined value, it is possible to actuate the valve member 12 with a high response by increasing the amount of the release current so that the valve transit time becomes small. On the other hand, when the engine is operating with a low revolution speed below the predetermined value, the valve member 12 need not be actuated with a high response. In this case, it is possible to reduce the power consumption of the electromagnetic actuating system 100 by setting the amount of the release current to be the above-mentioned value M.

As mentioned above, according to the present embodiment, it is possible to improve the response of the movement of the valve member 12 by supplying the release current to the upper coil 48 or the lower coil 50 when the valve member 12 is moved from the fully closed position or the fully opened position. In this case, the response of the valve member 12 can be further improved by continuing to supply the release current after the valve member 12 has started moving from the fully closed position or the fully opened position.

Additionally, the power consumption of the electromagnetic actuating system 100 can be changed in accordance with the amount of the release current. Thus, according to the present embodiment, it is possible to achieve a high response of the movement of the valve member 12 when the engine is operating with a high engine speed NE and to reduce the power consumption of the electromagnetic actuating system 100 when the engine is operating with a low engine speed NE, by changing the amount of the release current based on the engine speed NE.

Figure 4:
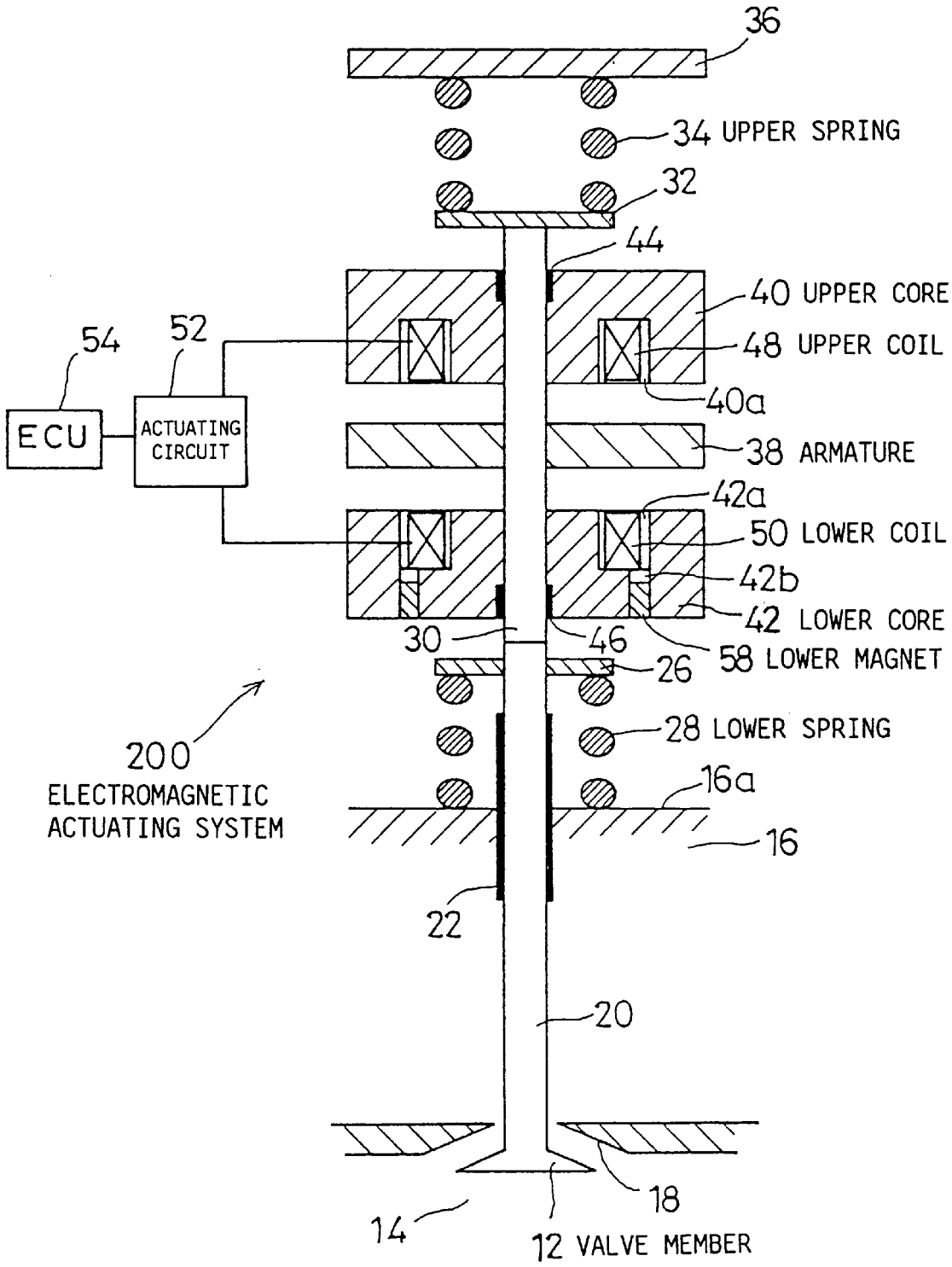
FIG. 4 is a diagram showing an electromagnetic actuating system of a second embodiment of the present invention.

Next, a description will be given of a second embodiment of the present invention. FIG. 4 is a diagram showing an electromagnetic actuating system 200 of the present embodiment. In FIG. 4, parts which have the same functions as the parts shown in FIG. 1 are given the same reference numerals, and descriptions thereof will be omitted.

As shown in FIG. 4, the electromagnetic actuating system 200 of the present embodiment is achieved by omitting the upper magnet 56 in the electromagnetic actuating system 100 of the first embodiment. In the present embodiment, the valve member 12 functions as an exhaust valve of the engine.

Generally, the exhaust valve is opened in a situation where a high combustion pressure remains in the combustion chamber 14. Thus, the amount of the attracting current to be supplied to the lower coil 50 is relatively large since a sufficiently large electromagnet force must be exerted on the armature in the valve opening direction against the high pressure in the combustion chamber 14 when the valve member 12 is actuated to be opened. For this reason, in the electromagnetic actuating system 200 of the present embodiment in which the valve element 12 functions as the exhaust valve, power consumption of the lower coil 50 occupies a relatively large part of the total power consumption.

In the present embodiment, since only the lower magnet 58 is provided with the upper magnet 56 being omitted, a magnetic attracting force can be prevented from being exerted on the armature 38 against the movement thereof when the valve member 12 is actuated to be opened. Thus, since kinetic energy of the valve member 12 and the armature 38 is not lost by the magnetic attracting force, it is unnecessary to increase the attracting current to the lower coil 50 to compensate for the energy loss. Additionally, similar to a case of the electromagnetic actuating system 100 of the first embodiment, since the lower magnet 58 is provided to the lower core 42, the attracting current to be supplied to the lower coil 50 can be reduced by the magnetic attracting force exerted by the lower magnet 58 between the armature 38 and the lower core 42. Thus, according to the present embodiment, the power consumption of the electromagnetic actuating system 200 can be effectively reduced since the power consumption of the lower coil 50 which occupies a large part of the total power consumption of the system is reduced.

Additionally, since the upper magnet 56 is omitted, it is possible to reduce the amount of the release current to be supplied to the upper coil 48 when the valve member 12 is actuated from the fully closed position. Thus, the power consumption of the electromagnetic actuating system 200 can be further saved.

FIG. 5A is a time chart showing displacement of the valve member 12 which functions as the exhaust valve when the valve member 12 moves from the fully closed position to the fully opened position, and FIG. 5B is a time chart instruction currents supplied to the upper coils 48 and the lower coil 50 to achieve the displacement shown in FIG. 5A. In FIGS. 5A and 5B, solid lines indicate a case of the electromagnetic actuating system 200 of the present embodiment, and dotted lines indicate a case of a structure in which permanent magnets are provided to both the upper core 40 and the lower core 42 (that is, a structure of the electromagnetic actuating system 100 of the first embodiment; hereinafter referred to as a comparison structure).

As shown in FIGS.5A and 5B, according to the electromagnetic actuating system 200, since no magnetic attracting force is exerted by a permanent magnet between the armature 38 and the upper core 40, the valve element 12 moves in the valve opening direction with a high response, and additionally, the release current to be supplied to the upper coil 48 is reduced, as compared to a case of the comparison structure. Additionally, since the valve member 12 moves in the valve opening direction with a high response as mentioned above, the attracting current to be supplied to the lower coil 50 so as to actuate the valve member 12 to the fully closed position is reduced as compared to the case of the comparison structure.

FIG. 6 is a diagram showing power consumption of the electromagnetic actuating system 200 and power consumption of the comparison structure with distributions to the upper coil 48 and the lower coil 50. As shown in FIG. 6, the power consumption of the electromagnetic actuating system 200 is reduced as compared to the comparison structure due to a decrease in the power consumption of the lower coil 50. Since the upper coil 48 must be energized to hold the valve member 12 in the fully closed position in the electromagnetic actuating system 200 while the valve member 12 can be held in the fully closed position without energizing the upper coil 48 in the comparison structure, the power consumption of the upper coil 48 of the electromagnetic actuating system 200 is slightly increased as compared to a case of the comparison structure. However, since the power consumption of the lower coil 50 which is sufficiently larger than the power consumption of the upper coil 48 is reduced, it is possible to effectively save the total power consumption of the electromagnetic actuating system 200.

Additionally, according to the electromagnetic actuating system 200 of the present embodiment, amounts of heat generated by the upper coil 48 and the lower coil 50 are balanced since the power consumption of the lower coil 50 is reduced. Thus, it is possible to alleviate a cooling performance which is required of a cooling system of the electromagnetic actuating system 200. In this case, since maximum electric power which can be supplied to the coils is increased for a certain cooling performance of the cooling system, it is possible to operate the electromagnetic actuating system 200 in a situation where the engine operates with a higher load and a higher revolution speed.

Further, as mentioned with reference to the first embodiment, when the upper magnet 56 and the lower magnet 58 are provided to the upper core 40 and the lower core 42, respectively, the upper magnet 56 and the lower magnet 58 must be magnetized in opposite directions to each other so that the magnetic fluxes generated by these magnets go through the armature 38 in opposite directions to each other. In this case, two kinds of permanent magnets are required. On the contrary, in the present embodiment, since only the lower magnet 58 is provided, only one kind of a permanent magnet is required in the electromagnetic actuating system 200. Thus, according to the present embodiment, it is possible to reduce a cost of the electromagnetic actuating system 200.

Figure 7:
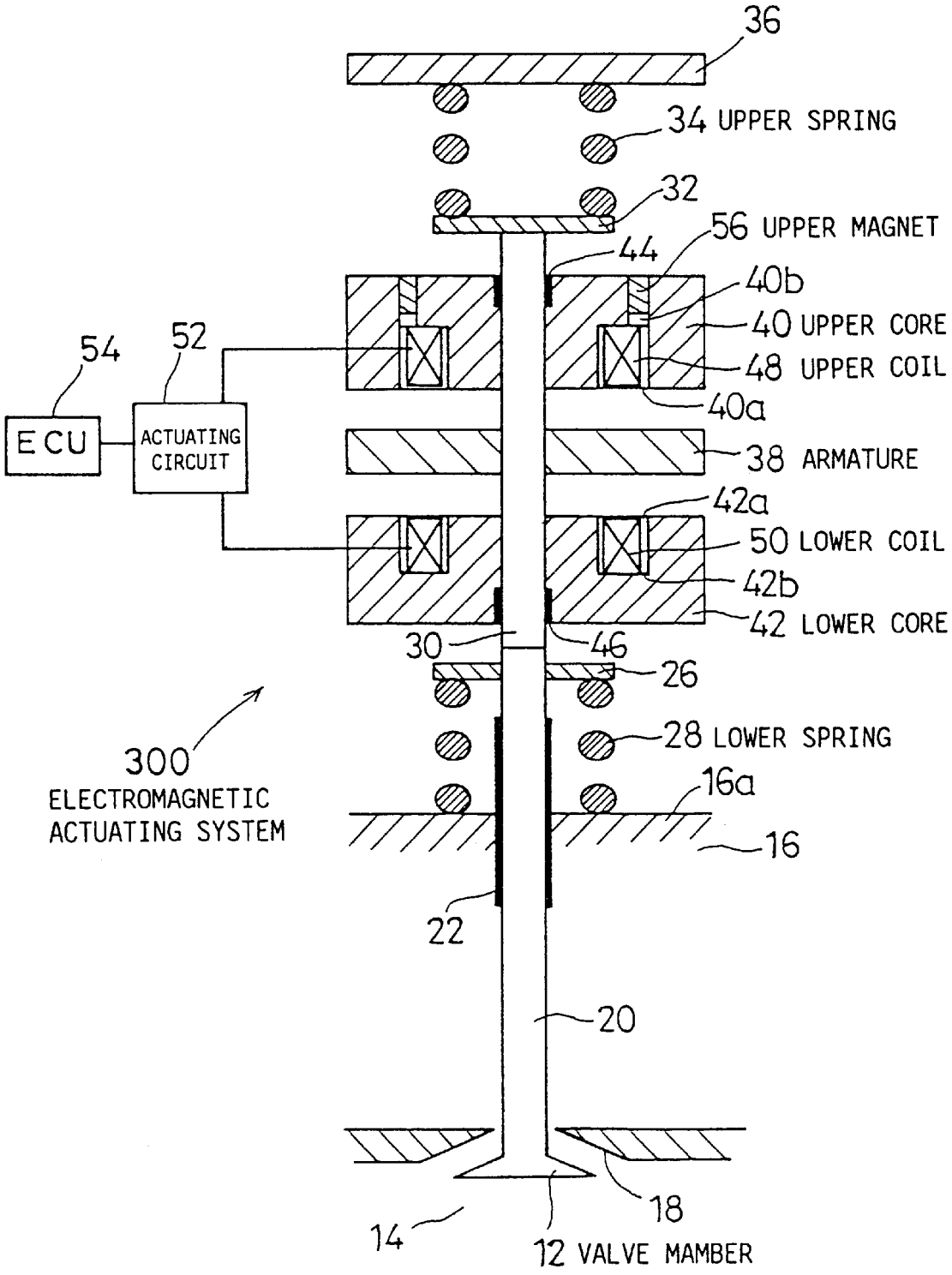
FIG. 7 is a diagram showing an electromagnetic actuating system of a third embodiment of the present invention.

Next, a description will be given of a third embodiment of the present invention. FIG. 7 is a diagram showing an electromagnetic actuating system 300 of the present embodiment. In FIG. 7, parts which have the same functions as the parts shown in FIG. 1 are given the same reference numerals, and descriptions thereof will be omitted.

As shown in FIG. 7, the electromagnetic actuating system 300 of the present embodiment is achieved by omitting the lower magnet 58 in the electromagnetic actuating system 100 of the first embodiment. In the present embodiment, the valve member 12 functions as an intake valve of the engine.

Generally, a time for which the intake valve is held in the fully closed position is longer than a time for which the intake valve is opened. Additionally, since the tappet clearance is provided between the valve shaft 20 and the armature shaft 30 in a state where the armature 38 and the valve member 12 are held in the fully closed position, as mentioned in the first embodiment above, the resilient force of the lower spring 28 does not contribute to a force for holding the armature 38 in the fully closed position. Thus, an attracting force to be exerted on the armature 38 to hold the valve member 12 in the fully closed position is relatively large. On the other hand, when the intake valve is opened, a high combustion pressure does not remain in the combustion chamber 14, contrary to a case of the exhaust valve. For these reasons, in the electromagnetic actuating system 300 in which the valve member 12 functions as the intake valve, electric power which is required to hold the valve member 12 in the fully closed position occupies a relatively large part of the total power consumption.

According to the present embodiment, since the upper magnet 56 is provided to the upper core 40, the amount of a current required to hold the armature 38 in the fully closed position is reduced, and, thus, the power consumption of the upper coil 48 is suppressed. In particular, when a specific volume of air of the engine is small, a control is generally performed for holding some of the intake valves in the fully closed position. According to the electromagnetic actuating system 300, the above-mentioned control can be achieved without energizing the upper coil 48 since the upper magnet 56 is provided. On the other hand, since a permanent magnet is not provided to the lower core 42, no magnetic attracting force is exerted by a permanent magnet between the armature 38 and the lower core 42 when the valve member 12 is actuated to be opened. Thus, power consumption of the lower coil 50 increases as compared to a case where the lower magnet 58 is provided to the lower core 42.

As mentioned above, in the electromagnetic actuating system 300 of the present embodiment, the power consumption of the upper coil 48 which occupies a relatively large part of the total power consumption of the system is reduced and the power consumption of the lower coil 50 which occupies a relatively small part of the total power consumption is increased. Thus, the amount of heat generated by the upper coil 48 and the amount of heat generated by the lower coil 50 are balanced. Consequently, according to the present embodiment, similar to the case of the electromagnetic actuating system 200 of the second embodiment, it is possible to alleviate the cooling performance of the cooling system of the electromagnetic actuating system 300 and to operate the electromagnetic actuating system 300 in a situation where the engine operates with a higher load and a higher revolution speed.

Additionally, since a permanent magnet is not provided to the lower core 42, no magnetic attracting force is exerted between the armature 38 and the lower core 42 when the valve member 12 is moved from the fully opened position toward the fully closed position. Thus, according to the electromagnetic actuating system 300, it is possible to actuate the valve member 12 from the fully opened position with a high response.

Further, since only the upper magnet 56 is provided as a permanent magnet, only one kind of a permanent magnet is required in the electromagnetic actuating system 300, and thus, a cost of the system can be reduced, as in the case of the second embodiment.

The present invention is not limited to these embodiments, but variations and modifications may be made without departing from the scope of the present invention.

The present application is based on Japanese priority application No. 10-347405 filed on Dec. 7, 1998, the entire contents of which are hereby incorporated for reference.

What is claimed is:

1. An electromagnetic actuating system, comprising:

a valve member which functions as an intake valve or an exhaust valve of an internal combustion engine;

an armature which moves with said valve member;

an electromagnet which attracts said armature in a direction of movement of said valve member by being supplied with a current;

a spring which presses said armature away from said electromagnet; and a current controller which supplies a release current to said electromagnet so that magnetic flux is generated in a direction opposite to a direction of magnetic flux generated by said permanent magnet when said armature is released from said electromagnet, said release current being supplied so as to move said armature all the way between a full open position and a closed position;

wherein said current controller controls an amount of said release current in accordance with an operating state of said internal combustion engine.

2. The electromagnetic actuating system as claimed in claim 1, wherein said operating state of the internal combustion engine is an engine speed.

3. The electromagnetic actuating system as claimed in claim 2, wherein said current controller increases the amount of said release current when the engine speed is greater than a predetermined value as compared to when the engine speed is smaller than the predetermined value.

4. An electromagnetic actuating system, comprising:

a valve member which functions as an intake valve or an exhaust valve of internal combustion engine;

an armature which moves with said valve member;

a pair of electromagnets which attract said armature in a valve-opening direction and a valve closing direction, respectively;

a spring which presses said armature toward a neutral position between said electromagnets;

a permanent magnet which can exert a magnetic attracting force between said armature and at least one of said electromagnets; and a current controller which supplies a release current to said at least one of the electromagnets so that magnetic flux is generated by said permanent magnet when said armature is released from said at least one of the electromagnets, said release current being supplied so as to move said armature all the way between a full open position and a closed position, wherein said current controller controls an amount of said release current in accordance with an operating state of said internal combustion engine.

5. The electromagnetic actuating system as claimed in claim 4, wherein said operating state of the internal combustion engine is an engine speed.

6. The electromagnetic actuating system as claimed in claim 5, wherein said current controller increases the amount of said release current when the engine speed is greater than a predetermined value as compared to when the engine speed is smaller than the predetermined value.

7. The electromagnetic actuating system as claimed in claim 4, wherein said permanent magnet is provided as a single magnet so as to exert a magnetic force between said armature and one of said electromagnets which one attracts said armature in a valve opening direction.

8. The electromagnetic actuating system as claimed in claim 4, where said permanent magnet is provided as a single magnet so as to exert a magnetic force between said armature and one of said electromagnets which one attracts said armature in a valve closing direction.

9. The electromagnetic actuating system as claimed in claim 4, wherein said permanent magnet is provided so as to correspond to each of said electromagnets so as to exert a magnetic attracting force between said armature and each of said pair of electromagnets.

10. The electromagnetic actuating system as claimed in claim 7, wherein said permanent magnet is accommodated in only one of said electromagnets which one applies an electromagnetic force to said armature in the valve opening direction.

11. The electromagnetic actuating system as claimed in claim 8, wherein said permanent magnet is accommodated in only one of said electromagnets which one applies an electromagnetic force to said armature in the valve closing direction.

12. The electromagnetic actuating system as claimed in claim 9, wherein said permanent magnet is accommodated in each of said electromagnets.

* * * * *